US006378768B1

(12) United States Patent
Belloise

(10) Patent No.: US 6,378,768 B1
(45) Date of Patent: Apr. 30, 2002

(54) MAILBOX CONSTRUCTION WITH INTEGRAL SLEEVE MOUNT

(76) Inventor: Michael J. Belloise, 2292 Broad St., Yorktown Heights, NY (US) 10598

( * ) Notice: Subject to any disclaimer, the term of this patent is extended or adjusted under 35 U.S.C. 154(b) by 0 days.

(21) Appl. No.: 09/551,987

(22) Filed: Apr. 15, 2000

(51) Int. Cl.[7] ..... B65D 91/00
(52) U.S. Cl. ..... 232/39; 248/146; 248/218.4
(58) Field of Search ..... 232/39, 17, 45; 248/121, 146, 218.4

(56) References Cited

U.S. PATENT DOCUMENTS 446,257 A * 2/1891 Lane ..... 232/39
1,994,186 A * 3/1935 Anderson ..... 232/39
4,367,844 A * 1/1983 Drummond ..... 232/39 X
4,496,123 A * 1/1985 Laramie ..... 248/121
4,951,905 A * 8/1990 Bronson et al. ..... 232/39 X
5,060,908 A * 10/1991 Sofy ..... 232/39 X
5,377,944 A * 1/1995 Getsinger ..... 248/218.4
5,386,938 A * 2/1995 West ..... 232/39
5,509,603 A * 4/1996 Hering ..... 232/39
5,664,748 A * 9/1997 Speece et al. ..... 232/39 X
5,941,455 A * 8/1999 Cutungo ..... 232/39
5,971,267 A * 10/1999 Beckman ..... 232/39

* cited by examiner

*Primary Examiner*—B. Dayoan
*Assistant Examiner*—William L. Miller

(57) ABSTRACT

Mailbox construction where an integral sleeve mount allows for easy installation over a user-supplied support, creating an interference fit without use of fasteners. The sleeve mount can be expandable to provide a mechanical bias, and can include friction materials, adhesives, knife mounts, or stab mounts. Angular deviation of the mailbox about a vertical axis is reduced or eliminated relative to prior art mounting schemes.

15 Claims, 9 Drawing Sheets

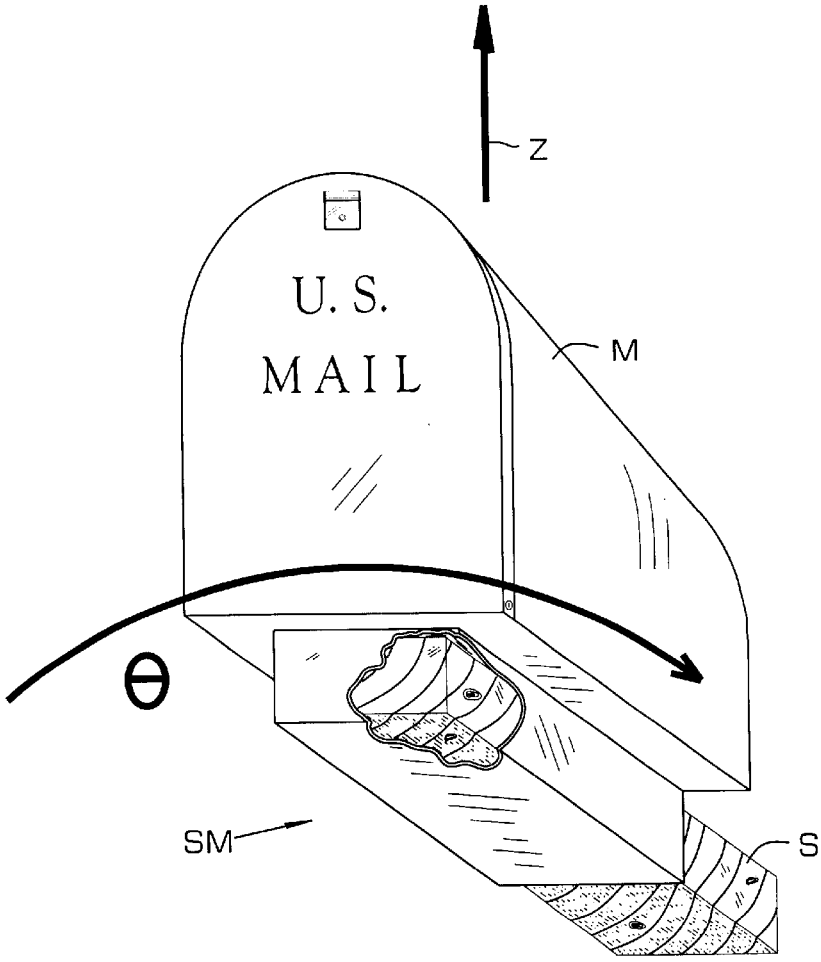
Fig. 11
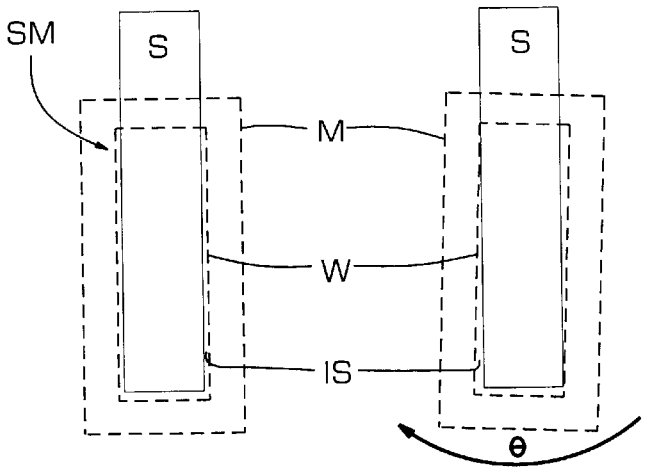
Fig. 12a
Fig. 12b
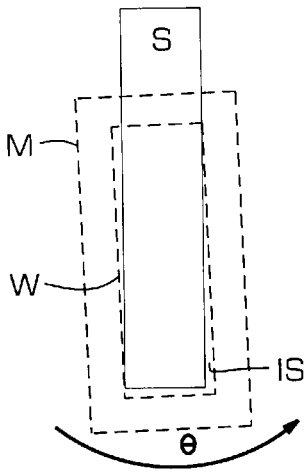
Fig. 12c

MAILBOX CONSTRUCTION WITH INTEGRAL SLEEVE MOUNT

This invention relates to mailbox construction and mailbox mounting methods and systems. Generally, the invention can be applied to all types of delivery and storage boxes that are to be hung or mounted on or near a horizontal post, vertical post, or oblique-angle post or support.

Most standard USPS mailboxes comprise an inset underside that allows for mechanical interfacing with a board or similar member, which in turn is often affixed to a vertical support. Prior art mailbox construction and mounting methods typically employ complex assemblies and often require many parts, and require fasteners, such as screws or nails for mounting and to reduce or eliminate angular deviations or play of the mailbox with respect to its support. Mounting prior art mailboxes requires some mechanical skill in assembling the necessary parts and engaging fasteners. Typically, installation requires some aligning of the mailbox with respect to its support to assure a true and straight installation free from angular deviations and mechanical play.

U.S. Pat. No. 4,496,123 to Laramie, for example, discloses a mailbox mounting scheme that includes an extendable support for supporting a mailbox in an extended or unextended position. Laramie requires the use of fasteners to secure the mailbox to the support, and the assembly is complex, and is prone to angular deviations and mechanical play in the assembled product. Removal and replacement of the mailbox requires complex disassembly and is time consuming. Similarly, U.S. Pat. No. 5,386,938 to West discloses a mailbox post mount that is also complex, not conducive for removal and replacement operations, and requiring the use of fasteners. U.S. Pat. No. 4,951,905 to Bronson et al. and U.S. Pat. No. 3,229,940 to Kagels also disclose mailbox mounts with the same disadvantages, and require skill, time and fasteners for installation.

It is therefore an object of this invention to provide a mailbox construction with an integral sleeve mount that requires no fasteners such as nails, screws or bolts. It is another object of this invention to provide a mailbox construction and mounting scheme that eliminates or minimizes angular deviations or mechanical play without the use of fasteners. It is yet another object of this invention to allow for either a permanent one step installation; or a semi-permanent one step installation; or a ion-permanent, easily removable installation, all with a minimum of mechanical skill required, and in minimum time.

Other objects will become apparent upon reading of the specification.

SUMMARY OF THE INVENTION

The present invention uses a mailbox comprising a sleeve mount that accommodates a user-supplied support, such as standard 2×4" lumber, obviating the need for expensive machined or formed pieces for mounting to a post, and not requiring the use of fasteners for installation.

In a first embodiment, a mailbox with an integral sleeve mounting system for engagement with a support is used where the mailbox comprises an integral sleeve mount positioned, shaped, and oriented so as to provide slidable mechanical cooperation with a mailbox support upon sliding the sleeve mount onto the support, whereby the sleeve mount securably mounts onto the support. To great advantage, the sleeve mount can be so shaped, configured and oriented so as to generate an interference fit with the support upon sliding the support into the sleeve mount. In another embodiment, the sleeve mount can be expandable, including optionally use of a expandable sleeve mount that comprises a wall cut-out, the wall cut-out so sized, configured and oriented so that at least one wall of the expandable sleeve mount is parted as the support is inserted into the sleeve mount, generating an interference fit with the support. In another embodiment, this expandable sleeve mount can additionally comprise a taper so sized and oriented so as to provide an interference fit with the support upon sliding the support into the sleeve mount.

Optionally, the sleeve mount can also comprise a friction surface positioned and oriented to frictionally engage with the support upon sliding support into the sleeve mount. Alternatively, the sleeve mount can comprise a stab element or elements positioned and oriented so as to be operative upon the support upon sliding the support into the sleeve mount. Another embodiment uses a sleeve mount comprising an adhesive pad so positioned, shaped, and configured so as to be operative upon the support upon sliding the support into the sleeve mount. Optionally, the sleeve mount can comprises a detent so positioned, shaped, and configured so as to be operative upon the support upon sliding the support into the sleeve mount.

Alternatively, the sleeve mount can be dropped into the mailbox by the installer. In one embodiment, a mailbox with an integral sleeve mount is provided, the mailbox comprising a sleeve mount in mechanical communication with the mailbox, the sleeve mount positioned, shaped, and oriented so as to provide slidable mechanical cooperation with a mailbox support upon sliding the support into the sleeve mount, whereby the sleeve mount securably mounts onto the support. This sleeve mount can be sized, oriented, positioned, and shaped so that the sleeve mount can be inserted into a mailbox floor, and mechanically cooperates and can be securable held between a mounting flange of the sleeve mount and the mailbox floor prior to insertion of the support into the sleeve mount.

The invention also comprises a method of mounting a mailbox to a support, the method comprising:

[1] providing in the mailbox a sleeve mount securably held in the mailbox;

[2] sliding the sleeve mount onto the support until mechanical cooperation between the sleeve mount and the support is attained.

This method can optionally employ an interference fit between the sleeve mount and the support as part of this mechanical cooperation. Optionally, the method can additionally comprise engaging a stab element in the sleeve mount so as to be operative upon the support upon sliding the support into the sleeve mount; the engaging can include reverse sliding of the sleeve mount with respect to insertion of the sleeve mount over the support, assisted by a use of percussive device such as a hammer operative to forceably move the sleeve mount with respect to the support. Alternatively, the method can additionally comprise engaging an adhesive pad in the sleeve mount so as to be operative upon the support upon sliding the support into the sleeve mount; or optionally can comprise engaging a detent in the sleeve mount so as to be operative upon the support upon sliding the support into the sleeve mount.

BRIEF DESCRIPTION OF THE DRAWINGS

FIG. 11 shows the oblique frontal view of FIG. 1, showing an angular deviation of the mailbox and sleeve mount with respect to the support;

FIGS. 12*a*, 12*b*, and 12*c* show rough top schematic view; showing a varying of the angular deviation depicted in FIG. 11;

DEFINITIONS

Figure 1:
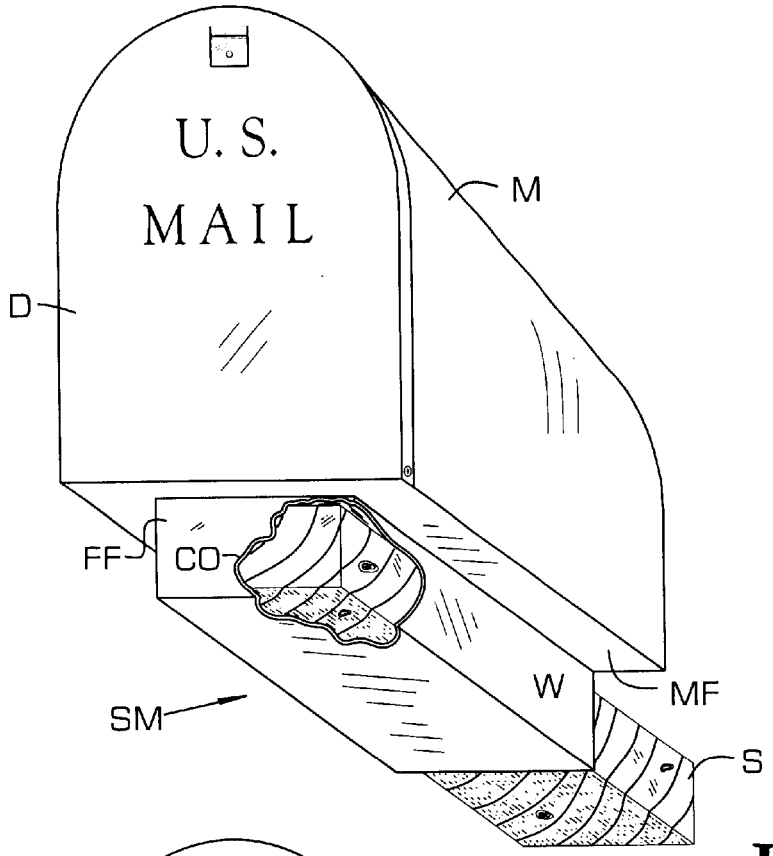
FIG. 1 shows an oblique frontal view of a mailbox with an integral sleeve mount according to the present invention, showing a cut-out of the sleeve mount.

The following definitions shall be employed throughout:

Adhesive pad shall include all types of adhesives, regardless of actual configuration or shape upon application, that serve to provide local adhesion upon sliding a sleeve 70 mount onto a support. Nothing here shall suggest that an adhesive must take the form of a pad; linear bead-like applications or other adhesive applications can be used.

Detent shall include known methods of indexing, alignment slots or tabs, bosses, holes, hubs, or the use of magnetic or other securing materials (e.g. glue) on or about a surface, such as a support surface or sleeve mount surface.

Expandable, such as where a sleeve mount is expandable, shall denote any design that comprises a wall or structure that moves in response to insertion of a support into a sleeve mount, whether or not such insertion causes establishment of a mechanical bias.

Integral when used to describe structural characteristics shall include the union of structures by known joining arts such as welding, the use of fasteners, and the use of interlocking tabs and the like. The term integral shall also include structure made whole by fabrication, such as by being cast in the same mold (e.g., injection-molded plastics) or pressed from the same sheet metal.

Interference fit shall include all manner of mechanical cooperation whereby angular deviation and/or linear play is reduced between two members, such as a support and a cooperating sleeve mount. Such an interference fit can for example, limit the motion of a support relative to a cooperating sleeve mount to nearly zero, giving a result that is equivalent or nearly equivalent to that obtained through the use of fasteners such as nails, screws, bolts and clips. The use of appropriately placed glue, friction surfaces, stab mounts, knife edges and the like can be included in this definition.

Mailbox shall include not only U.S. and international postal mailboxes, but shall also include all types of delivery boxes (e.g., newspaper boxes, key storage bins, ministorage lockers or holds) and also any box or storage container envisioned to be hung or mounted on or near a horizontal post, vertical post, or oblique-angle post or support.

Mechanical bias shall include any biasing mechanism, whether originating from mechanical, electrical, electromechanical, or of any other type of mechanism, which provides a force as a function of deviation from an equilibrium position.

Mounting flange shall include any mechanical means by which a first member, such as a sleeve mount, shall secure itself to or mechanically cooperate with a second member, such as a mailbox floor, without falling through the second member, or causing excessive play or looseness between the first and second members. This shall include the use of tabs, flanges, and cross-bars that operate as needed.

Parted, when referring to a wall cut-out in a sleeve mount, shall refer either to motion of a wall due to insertion of a support into the sleeve mount, generating a mechanical bias therein, or to an increase in the size or extent of the cut-out, generating a mechanical bias in a similar manner.

Percussive device shall include all material bodies or tools that use mechanical inertia and momentum to provide an impulse or momentary force is needed, such as hammers and sliding weights.

Sleeve mount shall include any member, set of walls, or structure that affixes to or mechanically cooperates with a support and is integral with or affixed to a mailbox such that fasteners are not needed for securably mounting to the support.

Sliding shall include any movements of a support relative to a sleeve mount, regardless of direction or history of motion. Sliding shall therefore comprise reverse sliding or movement, that is, movement in a direction contrary to the general motion required to mount a sleeve mount onto a support, such as when a support is hit with a hammer in a reverse direction to "set" a stab mount in the sleeve mount.

Stab element in connection with a sleeve mount or support shall include all manner of edges, knife edges, sharp tabs, protrusions, needles, or mechanical features that operatively engage upon a support to provide the mechanical equivalent of an interference fit between the sleeve mount and support. A stab element need not be of a material or,structure distinct from the sleeve mount or supper, e.g., sharp edges can be made from the native material or structure involved.

Support shall include any structural element that supports and mechanically engages with a sleeve mount.

DETAILED DESCRIPTION OF THE INVENTION

Referring to FIG. 1, an oblique frontal view of a mailbox with on integral sleeve mount according to the present invention is shown. Mailbox M Is shown having door D, and an integral sleeve mount SM which can be made part of the mailbox, such as by being made integral (see definition) with mailbox floor MF as shown. Sleeve mount SM is sized, shaped, and oriented so that the mailbox M can be mounted upon a user-supplied support S, such as a commonly available nominal size 2×4 inch lumber piece. Support S can be affixed to a vertical post (not shown) or any other support member without departing from the invention. For installation, sleeve mount SM is oriented adjacent support S, and slid thereupon, until the support S in sufficiently inserted, or until support S hits or back up upon a front face FF as shown. FIG. 1 shows a cut-out CO of the sleeve mount, revealing such a support S inserted until it is touching front face FF, completing the installation without use of fasteners, and permitting easy disassembly if desired. In sleeve mount SM, only a minimum number of walls W as shown are required to mechanically cooperate with support S, but the sleeve mount SM can be five sided as shown, or take other shapes without departing from the scope of the invention. The thickness of lumber shown is illustrative only and thicker or thinner supports may be used, such as made from 4"×4" lumber or ¼" thick mild steel stock.

Figure 2:
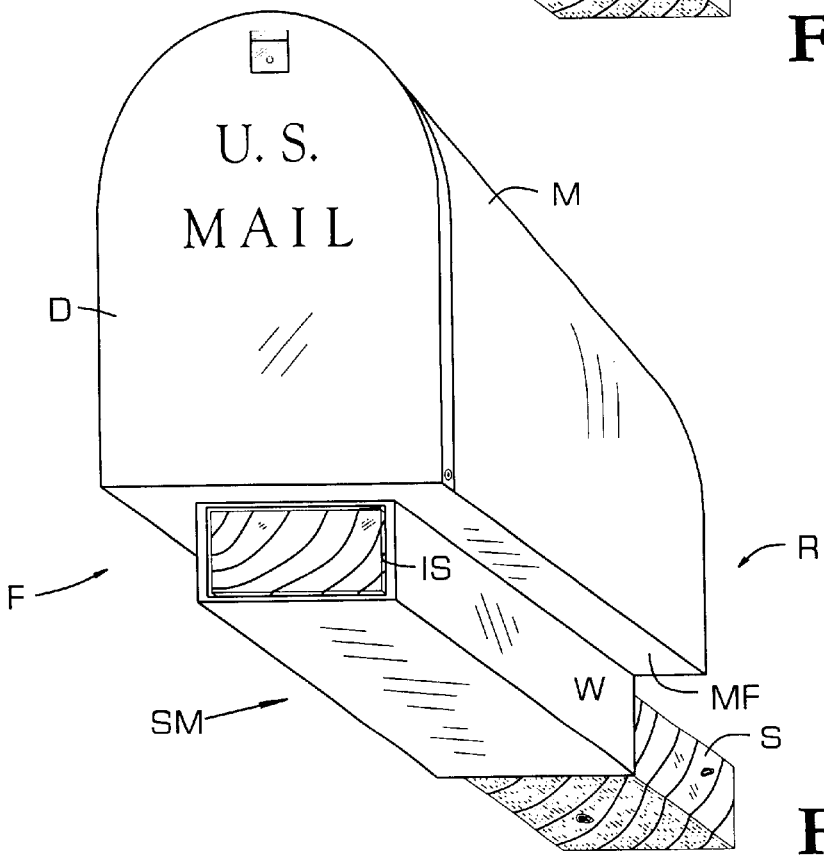
FIG. 2 allows an oblique frontal view of a mailbox with an integral sleeve mount with the sleeve mount front face removed.

Now referring to FIG. 2, an oblique frontal view of a mailbox with an integral sleeve mount is shown, with the sleeve mount front face FF removed for clarity. Mailbox M has a front portion F and rear portion R as shown. As mentioned, the sleeve mount SM does not have to have all the walls shown, and front face FF adjacent to the front portion F can be omitted. Upon installation, there can be a interstitial space IS between the support S and the interior of sleeve mount SM as shown. This interstitial space can be foam-filled or otherwise modified as discussed below.

Figure 3:
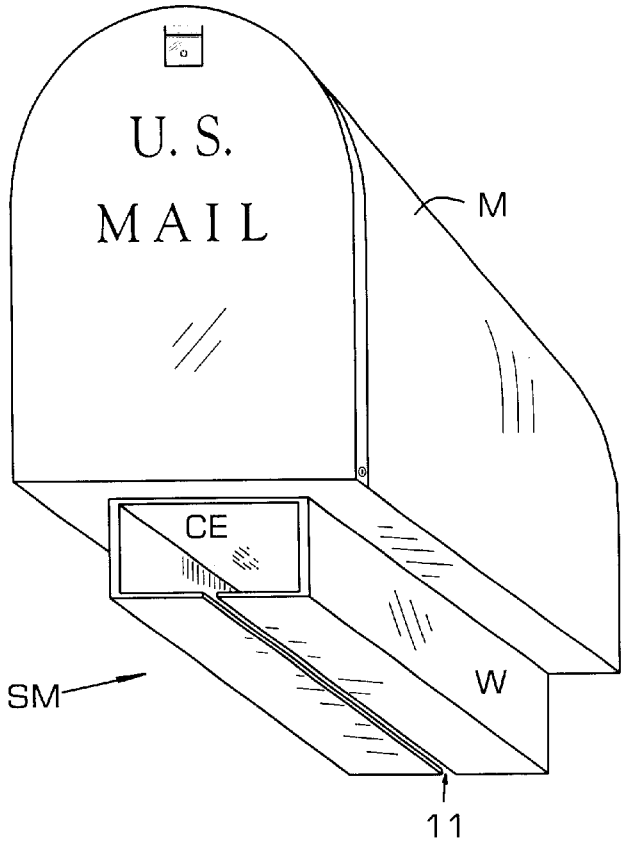
FIG. 3 shows an oblique frontal view of a mailbox with an expandable integral sleeve mount.
Figure 4:
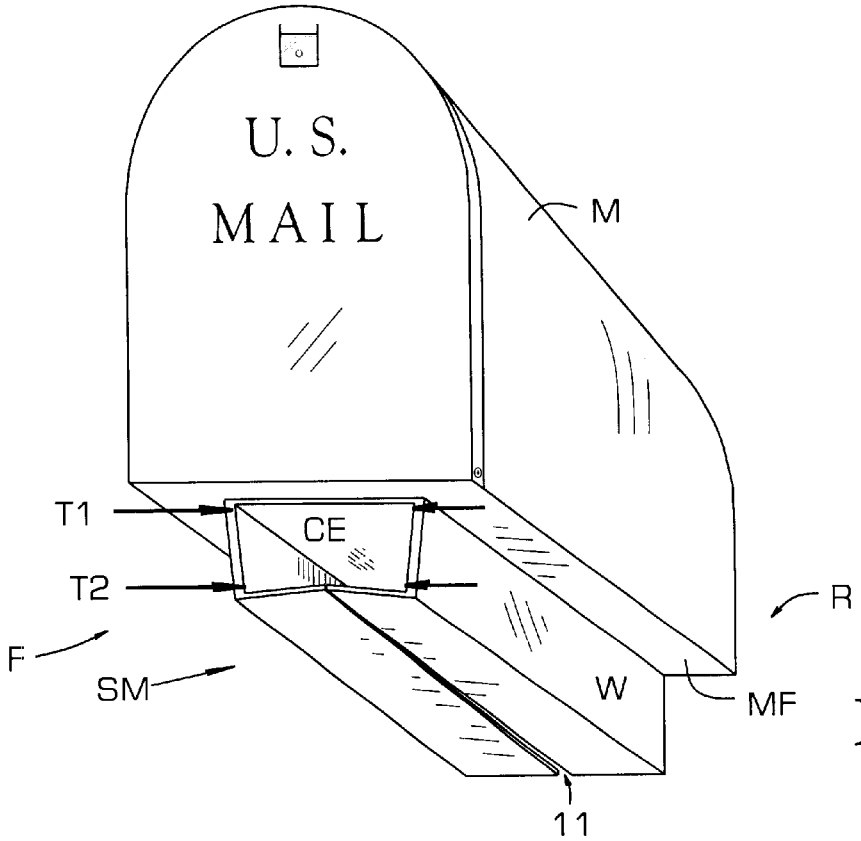
FIG. 4 shows an oblique frontal view of a mailbox with an expandable integral sleeve mount featuring a front to back taper.
Figure 5:
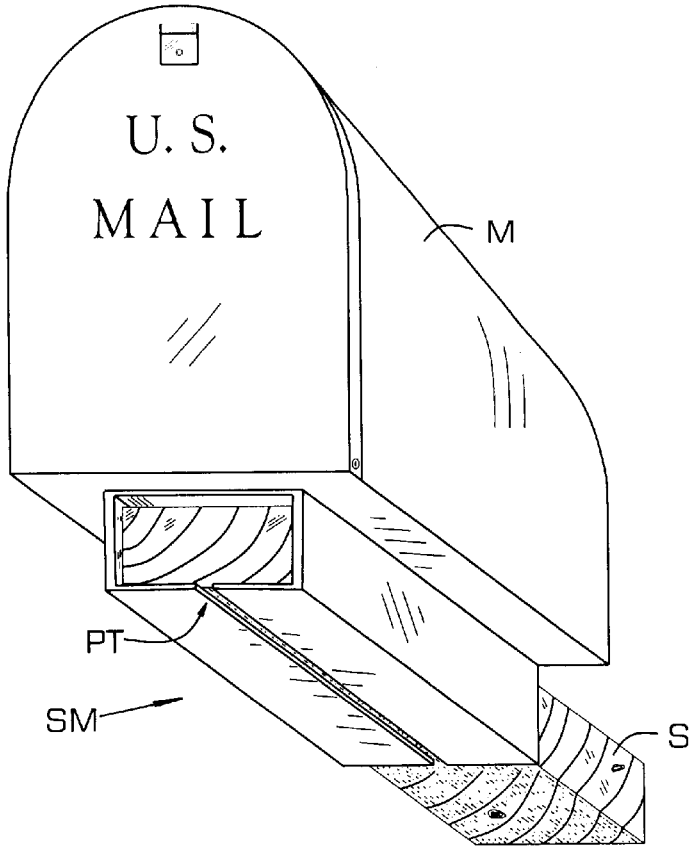
FIG. 5 shows the oblique frontal view of a mailbox of FIG. 4. with a support inserted into the integral sleeve mount.

Now referring to FIGS. 3, 4, and 5, an oblique frontal view of a mailbox with an optional expandable integral sleeve mount is shown. Sleeve mount SM can comprise a ceiling is as shown, which can be part of the sleeve mount SM proper, or simply part of the mailbox floor MF. As shown, sleeve mount SM can be so sized, shaped, and configured so that a cut-out 11 of one of the sleeve mount SM wells W allows for expandability upon insertion of support S during installation. This is particularly easy if the mailbox construction comprises plastic or polymer materials or structures that allow for melding and provide for restoration forces when bent.

Optionally, sleeve mount SM can comprise a taper such that the available width of sleeve mount SM at the front portion F is slightly smaller than that adjacent the rear portion R. This can provide for the use of slightly different sizes of supports S, and most importantly, can provide for an interference fit between sleeve mount SM and support S. This allows for a tight installation without need for fasteners, as mentioned. To enhance expandability, sleeve mount SM can comprise a top/bottom taper as shown, wherein the taper width T1 adjacent sleeve mount ceiling CE is slightly larger than the corresponding taper width T2 at the bottom of the figure. This taper can itself be tapered or graduated along the length of the mailbox M as shown, so that the corresponding taper widths T1 and T2 that could be shown (but not shown) adjacent the rear portion R would be the same or nearly the same, that is, T1 equal to T2. This is the particular configuration shown here. This allows that wall cut-out 11 narrows towards front portion F, as shown. With the support S slidably inserted upon sleeve mount SM, wall cut-out 11 becomes parted, an shown in the direction of reference PT. This provides a very useful mechanical bias and interference fit between sleeve mount SM and support S. This type of open sleeve mount allows adaptation to slightly different dimensions in lumber or supports, allowing easy accommodation of support production tolerances, or regional differences in widths of support S.

Figure 6:
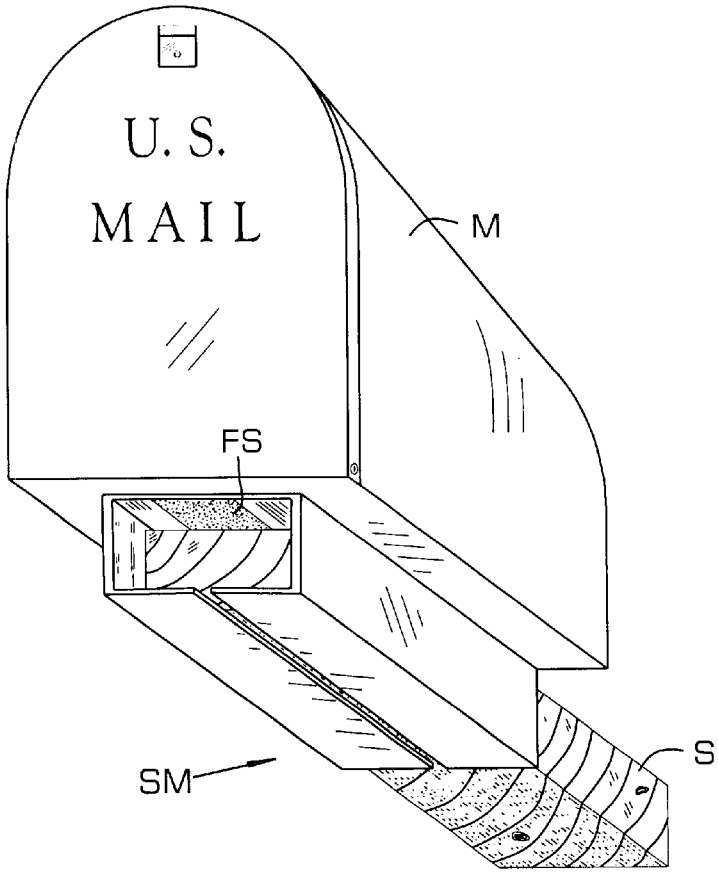
FIG. 6 shows an oblique frontal view similar to that shown in FIG. 5, revealing a frictional surface in the sleeve mount ceiling.

Now referring to FIG. 6, an oblique frontal view similar to that shown in FIG. 5 is shown, but now with the support S inserted only partially in sleeve mount SM, a frictional surface FS is revealed as shown in the sleeve mount ceiling. This further provides for an interference fit, eliminating mechanical play and the need for fasteners such as bolts and screws. Frictional surface FS can be provided using separate known materials such as adhesive sandpaper applied to ceiling CE, but need not be of a material or structure distinct from the sleeve mount or support, e.g., a friction surface can be made from the materials used, via known machining or surface processes. Frictional surfaces FS can also be applied or operative at any of walls W, although the sleeve mount ceiling CE is preferred because the effect of the frictional surface is enhanced with the weight of mailbox M upon it.

Figure 7:
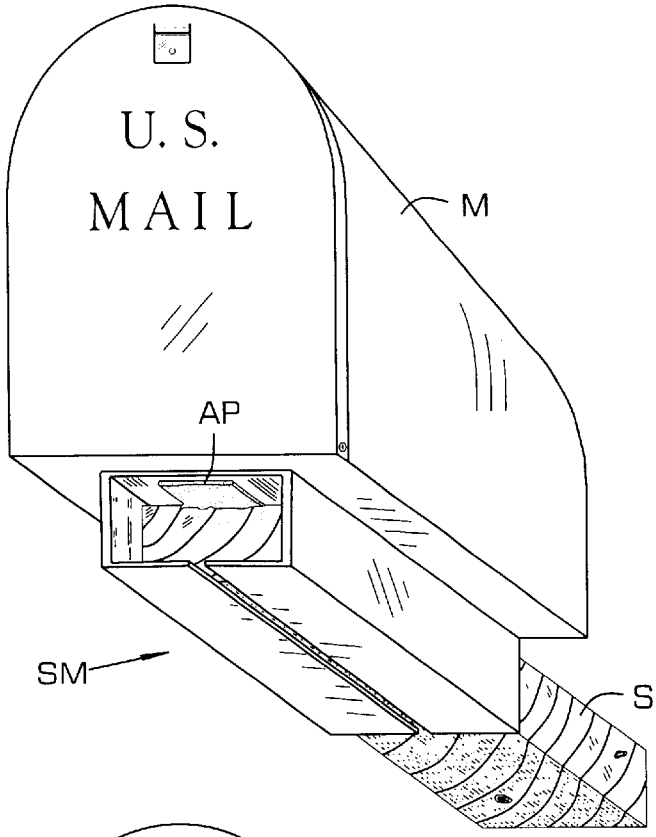
FIG. 7 shows an oblique frontal view similar to that shown in FIG. 6, but revealing instead an adhesive pad on the sleeve mount ceiling.

FIG. 7 shows an alternative embodiment that provides for an interference fit as discussed with or without need for tapered or expandable sleeve mounts SM. An adhesive pad AP is provided as shown in sleeve mount ceiling CE. As support S is slid into sleeve mount SM, the adhesive pad can be operative upon support S, providing for a permanent or semi-permanent installation upon completion, with an interference fit assured. Again note that optional front face FF is not shown for clarity. Adhesive pad AP can be custom fabricated using injectors, applicators or rollers on a production line. Known adhesive pads, perhaps with adhesive backing can be affixed to the sleeve mount ceiling CE. Such pads are manufactured by 3M Corporation of Minnesota, USA, or other vendors.

Figure 8:
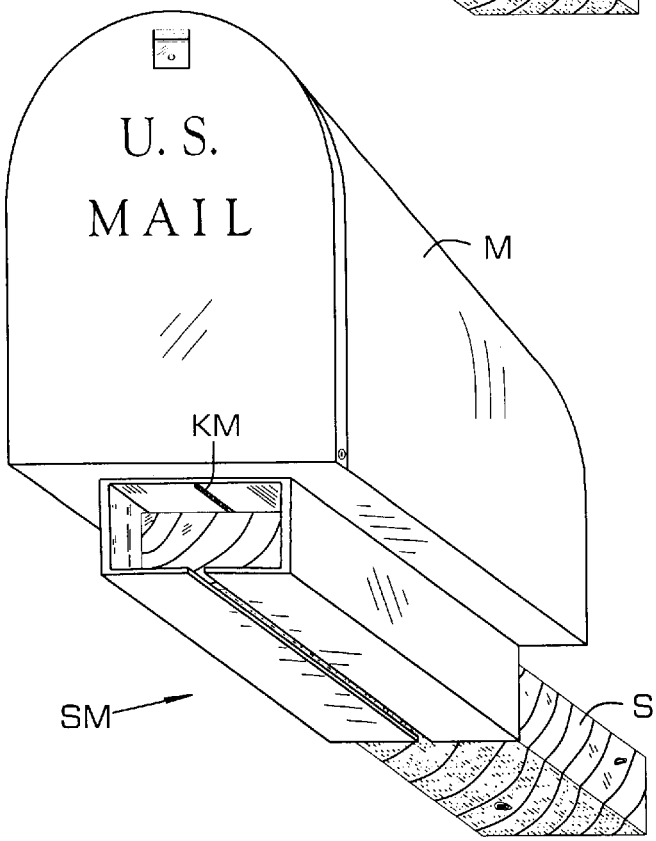
FIG. 8 shows an oblique frontal view similar to that shown in FIG. 6, but revealing a knife mount in the sleeve mount ceiling.

FIG. 8 shows an oblique frontal view similar to that shown in FIG. 6, but revealing an alternative embodiment using a knife mount in the sleeve mount ceiling CE. One knife mount or edge KM is shown, and can be provided in sleeve mount SM using known processes. Multiple knife mounts can be used, alone, or in combination with any other mechanisms or arrangements taught here or obvious through standard engineering practice accessible to those with ordinary skill in the art. The knife mount allow for an interference fit between sleeve mount SM and support S, and at the same time can provide for easy disassembly along a freshly cut knife edge on support S, not shown.

New referring to FIG. 9 an oblique frontal view similar to that shown In FIG. 6 is shown, but revealing a stab mount STM in the sleeve mount ceiling CE (or in any of walls W) Using stab mount STM in the sleeve mount SM allows for sliding support S into sleeve mount SM, but allows for permanent or semi-permanent engagement of sleeve mount SM onto support S, especially if support S is lodged backward after insertion, as discussed below.

Figure 9:
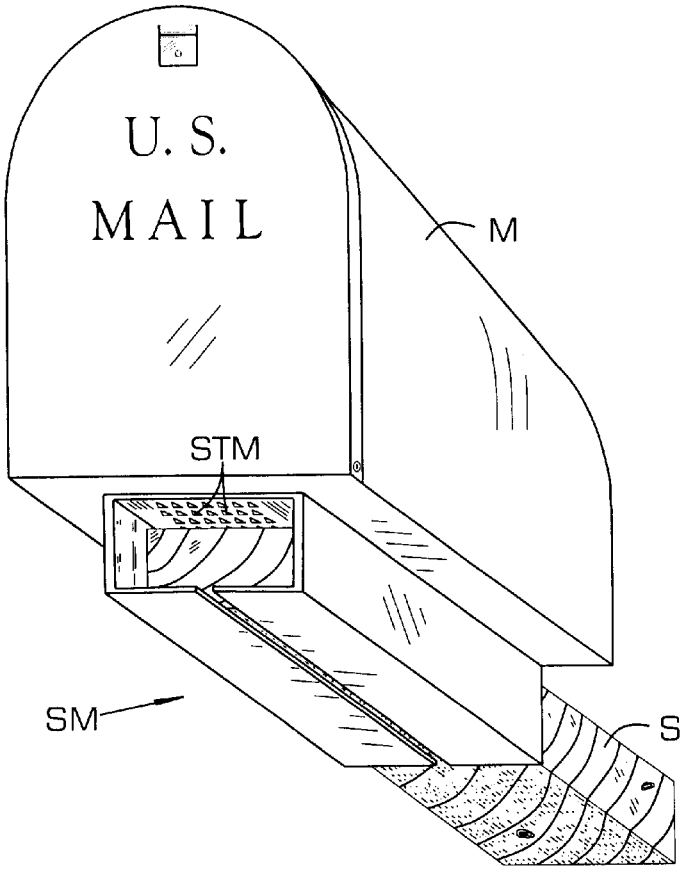
FIG. 9 shows an oblique frontal view similar to that shown in FIG. 6, but revealing a stab mount in the sleeve mount ceiling.
Figure 10A:
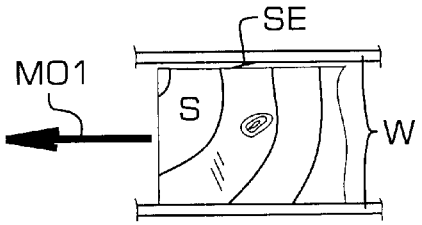
FIGS. 10*a* and 10*b* show partial cross sectional views demonstrating the operation of the stab mount depicted in FIG. 9.
Figure 10B:
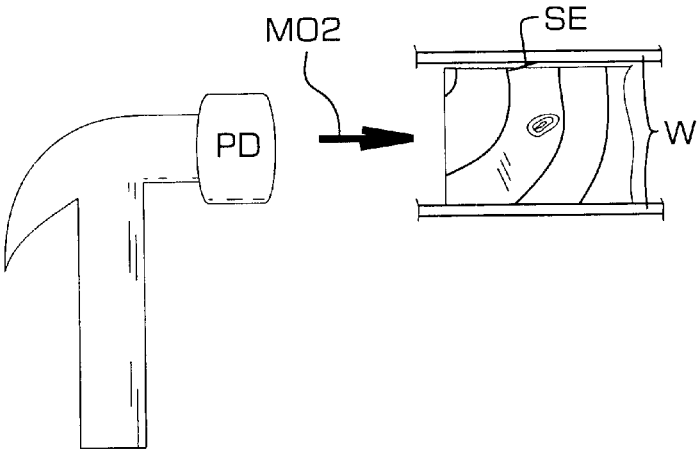

FIGS. 10*a* and 10*b* show partial cross sectional views demonstrating the operation of the stab mount depicted in FIG. 9. Upon initial insertion motion (shown in the direction MO1) of support S into sleeve mount SM, one or more stab elements SE slide or scrape across support S as shown, aided by any pressure provided by walls W as shown. To engage more fully stab element SE, the support S can be reverse slid in the direction MO2 as shown, causing stab element SE to dig into support S, an action which can be self-reinforcing by possible motion of the stab element SE downward in the figure. This reverse slide can be aided by a percussive device PD such as a hammer, so that a plurality of stab elements SE can be engaged upon support S. This again provides for a fast, efficient and tight installation without need for fasteners.

The effect of the various mounting schemes (expandable sleeve mount; friction mount; adhesive mount; knife mount; stab mount; insertion of foam or other shim-like materials in interstitial spaces IS) is to limit mechanical play, including any angular deviation about a vertical axis as shown in FIG. 11 where the oblique frontal view of FIG. 1 is shown, depicting an angular deviation of the mailbox 14 and sleeve mount SM with respect to the support S. An angular deviation theta (shown θ) about a vertical axis, shown Z, is possible, such as when one grabs mailbox M and attempts to turn it about axis Z. This angular deviation is also shown in FIGS. 12*a*, 12*b*, and 12*c*, which give rough top schematic views of mailbox M, support S, walls W end interstitial space IS, as shown. In FIG. 12*a*, no angular deviation θ is shown, while in FIGS. 12*b* and 12*c*, an angular deviation θ of the mailbox M and associated structures is shown in two different respective directions. Using the teachings of this invention, such angular deviations (and mechanical play in general) can be reduced or eliminated by establishing an interference fit, as discussed above, without need for fasteners as taught in the prior art.

Figure 13:
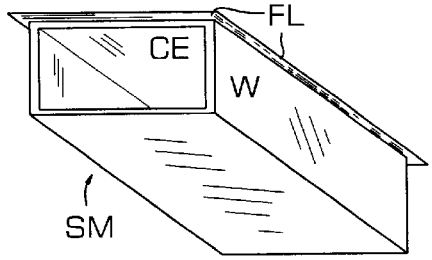
FIGS. 13–17 show oblique frontal views of a mailbox with a drop-in sleeve mount.
Figure 14:
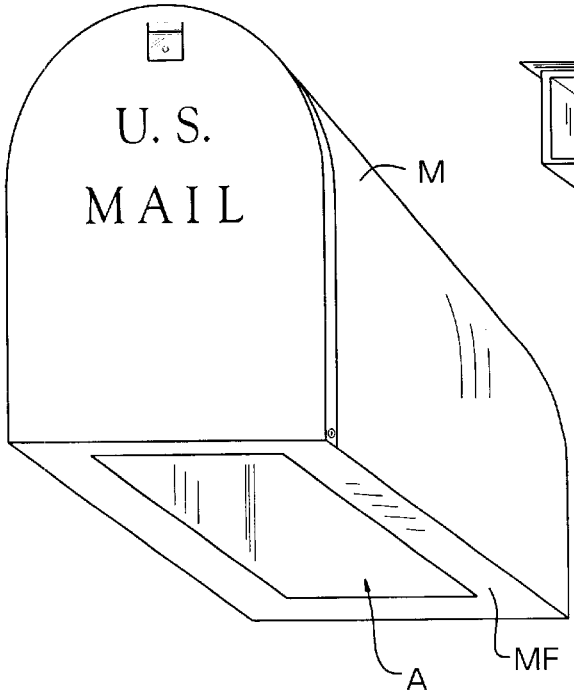
Figure 15:
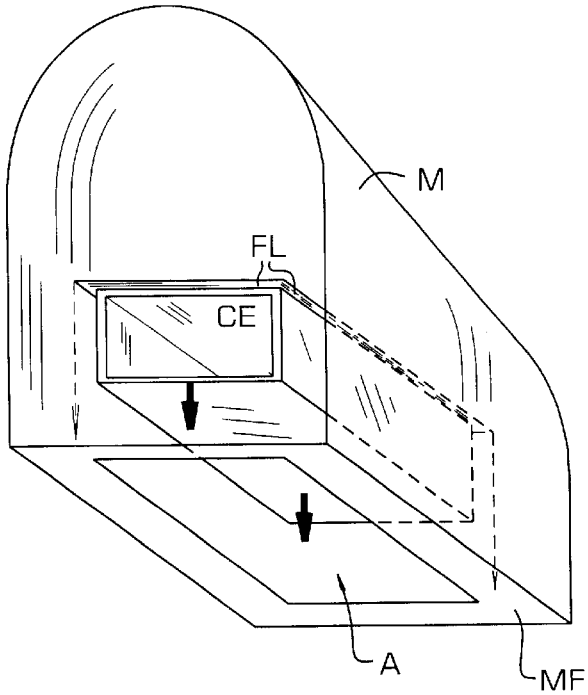
Figure 16:
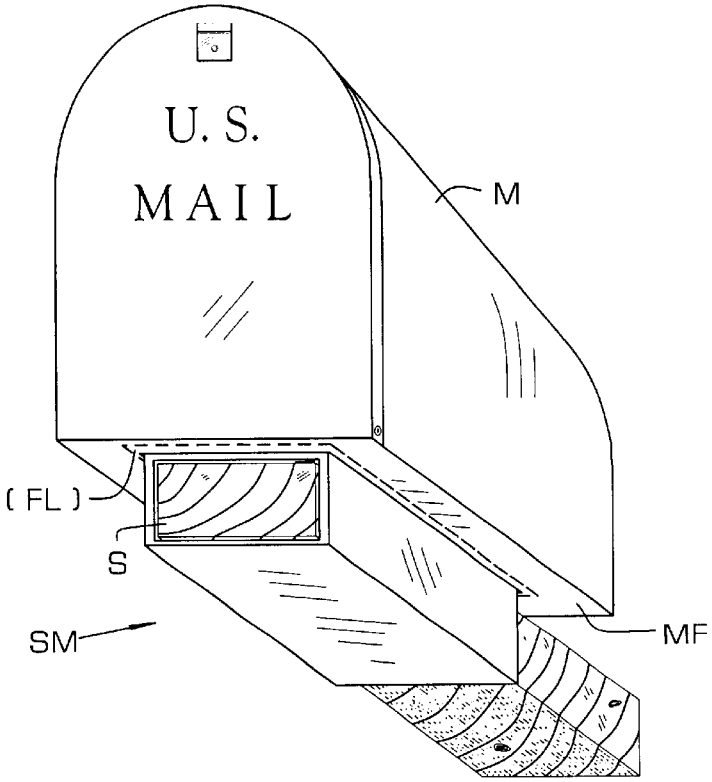
Figure 17:
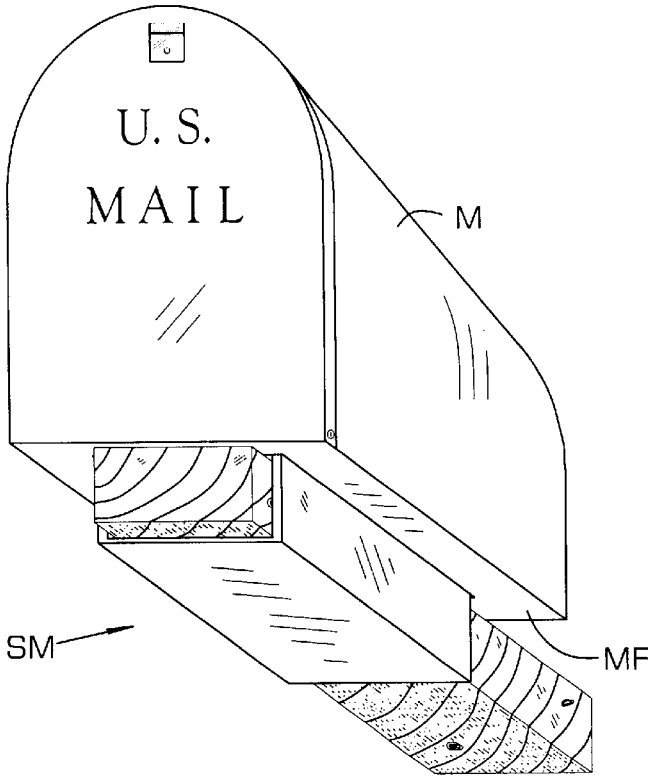

FIGS. 13–17 show oblique frontal views of a mailbox M according to the present invention, with a drop-in sleeve mount for simplicity in packaging and design. In FIG. 14, a mailbox M is shown with an aperture A formed in mailbox floor MF. FIG. 13 shows a "drop-in" sleeve mount SM comprising a flange FL adjacent sleeve mount ceiling CE. For installation, one drops sleeve mount SM into the aperture A as depicted shown via arrows shown in FIG. 15, which provides a glimpse of the interior of mailbox M with the door D removed for clarity. Upon dropping sleeve mount SM into the mailbox floor MF of mailbox M, the support S can then be inserted, as shown in FIG. 16, which shows how flange FL hits upon or engages mailbox floor MF, preventing further downward motion of sleeve mount SM. When the mailbox M rests, portions of support S that protrude from sleeve mount SM allow for support, as shown. In lieu of flange FL, cross bars or other supporting structures can be used.

Figure 18:
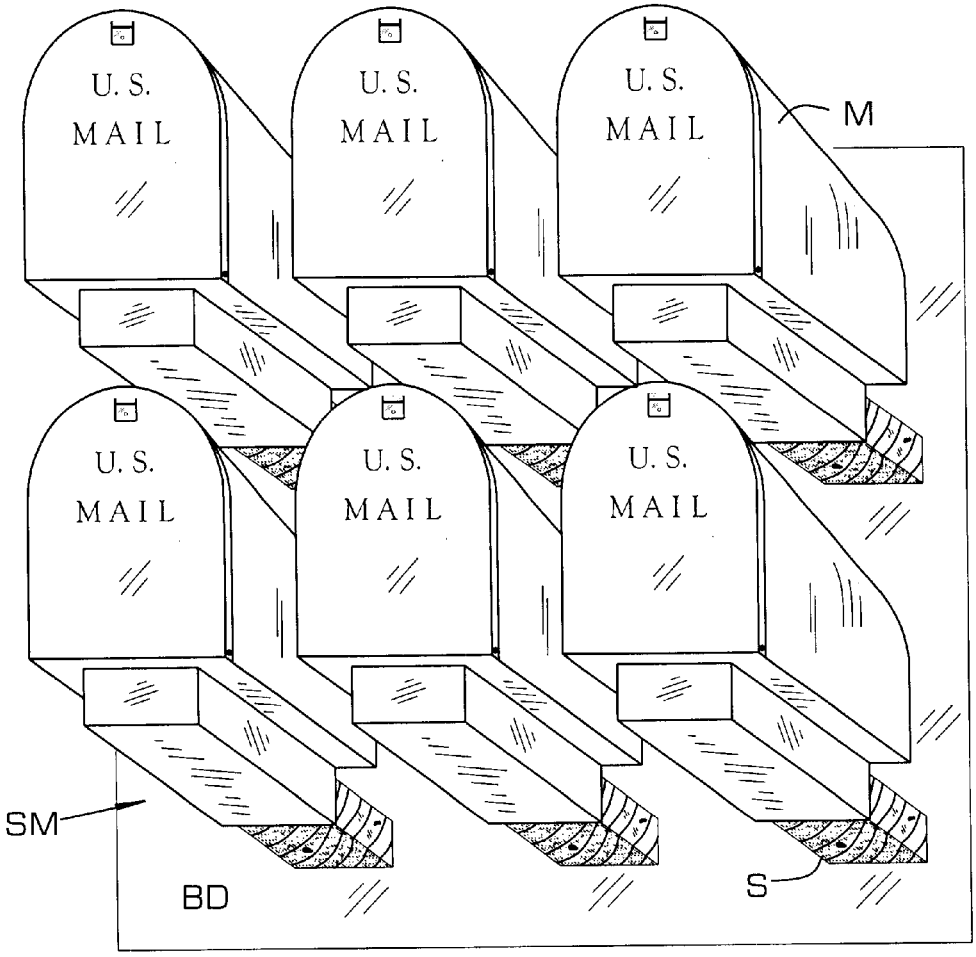
FIG. 18 shows six mailboxes as depicted in FIG. 1, mounted upon supports arrayed from a mounting board.

FIG. 18 shows six mailboxes as depicted in FIG. 1, mounted upon supports S arrayed from a mounting board BD, such as where condominiums or other close packed housing units create the need for a high number of mailboxes accessible with ease by delivery personnel. The teachings presented here allow for extremely fast and easy mounting without use of fasteners. The interference fits hereby attained provide for professional installations without much skill, and without complex assemblies or many cooperating pats.

Specialized materials can be placed on other interior sides of sleeve mount SM not shown, and these materials (e.g., foam) can be installed or made integral with the interior sides of sleeve mount SM to reduce angular deviations about a vertical axis Z as discussed above.

Obviously, many modifications and variations of the present invention are possible in light of the above teaching. It is therefore to be understood, that within the scope of the appended claims, the invention can be practiced otherwise than as specifically described or suggested here.

I claim:

1. A mailbox having a floor and side wall projecting from said floor, and with an integral sleeve mounting system adapted to mounting onto a horizontal supports said mailbox comprising:

an integral sleeve mount in mechanical communication with said mailbox, said integral sleeve mount positioned, shaped, and oriented so as to provide slidable mechanical cooperation with said horizontal support upon sliding said horizontal support into said integral sleeve mount, whereby said integral sleeve mount securably mounts onto said horizontal support; and wherein said integral sleeve mount is sized, oriented, positioned, and shaped so that said integral sleeve mount can be inserted into said mailbox floor, and can mechanically cooperate with and can be securably held between a mounting flange of said integral sleeve mount and said mailbox floor prior to insertion of said horizontal support into said integral sleeve mount.

2. The mailbox of claim 1, wherein said integral sleeve mount is so shaped, configured and oriented so as to generate an interference fit with said horizontal support upon sliding said horizontal support into said integral sleeve mount.

3. The mailbox of claim 1, wherein said integral sleeve mount is expandable.

4. The mailbox of claim 3, wherein said expandable integral sleeve mount comprises a wall cut-out, said wall cut-out so sized, configured and oriented so that at least one wall of said expandable integral sleeve mount is parted as said horizontal support is inserted into said integral sleeve mount, generating an interference fit with said horizontal support.

5. The mailbox of claim 4, wherein said expandable integral sleeve mount additionally comprises a taper so sized and oriented so as to provide an interference fit with said horizontal support upon sliding said horizontal support into said integral sleeve mount.

6. The mailbox of claim 1, wherein said integral sleeve mount comprises a friction surface positioned and oriented to frictionally engage with said horizontal support upon sliding said horizontal support into said integral sleeve mount.

7. The mailbox of claim 1, wherein said integral sleeve mount comprises a stab element positioned and oriented so as to be operative upon said horizontal support upon sliding said horizontal support into said integral sleeve mount.

8. The mailbox of claim 1, wherein said integral sleeve mount comprises an adhesive pad so positioned shaped, and configured so as to be operative upon said horizontal support upon sliding said horizontal support into said integral sleeve mount.

9. The mailbox of claim 1, wherein said integral sleeve mount comprises a detent so positioned, shaped, and configured so as to be operative upon said horizontal support upon sliding said horizontal support into said integral sleeve mount.

10. A method of mounting a mailbox to a horizontal support, said mailbox having a floor and side walls projecting from said floors and having a drop-in sleeve mount for engagement with a horizontal support said method comprising:

[1] dropping said drop-in sleeve mount (SM) into said mailbox floor so that said drop-in sleeve mount mechanically cooperates with and is securably held between a mounting a flange thereof and said mailbox floor;

[2] orienting said drop-in sleeve mount in said mailbox so as to cooperate with said horizontal support;

[3] sliding said drop-in sleeve mount onto said horizontal support until mechanical cooperation between said drop-in sleeve mount and said horizontal support is attained.

11. The method of claim 10 wherein said mechanical cooperation comprises an interference fit between said drop-in sleeve mount and said horizontal support.

12. The method of claim 10, wherein said method additionally comprises engaging a stab element in said drop-in sleeve mount so as to be operative upon said horizontal support upon sliding said horizontal support into said drop-in sleeve mount.

13. The method of claim 12, wherein said engaging includes reverse sliding of said drop-in sleeve mount with respect to insertion of said drop-in sleeve mount over said horizontal support, assisted by a use of percussive device operative to forceably move said drop-in sleeve mount with respect to said horizontal support.

14. The method of claim 10, wherein said method additionally comprises engaging an adhesive pad in said drop-in sleeve mount so as to be operative upon said horizontal support upon sliding said horizontal support into said drop-in sleeve mount.

15. The method of claim 10, wherein said method additionally comprises engaging a detent in said drop-in sleeve mount so as to be operative upon said horizontal support upon sliding said horizontal support into said drop-in sleeve mount.

* * * * *